US009598223B2

(12) United States Patent
Mizoguchi et al.

(10) Patent No.: US 9,598,223 B2
(45) Date of Patent: Mar. 21, 2017

(54) PLUNGER FOR PNEUMATIC DISPENSER

(71) Applicant: KAGA WORKS CO., LTD., Nagoya-shi (JP)

(72) Inventors: Osamu Mizoguchi, Nagoya (JP); Hitoshi Tsujikawa, Nagoya (JP); Kyota Imai, Nagoya (JP)

(73) Assignee: KAGA WORKS CO., LTD., Nagoya-Shi (JP)

( * ) Notice: Subject to any disclaimer, the term of this patent is extended or adjusted under 35 U.S.C. 154(b) by 202 days.

(21) Appl. No.: 14/388,934

(22) PCT Filed: Nov. 28, 2012

(86) PCT No.: PCT/JP2012/080786

§ 371 (c)(1),
(2) Date: Nov. 25, 2014

(87) PCT Pub. No.: WO2013/150683

PCT Pub. Date: Oct. 10, 2013

(65) Prior Publication Data

US 2015/0069091 A1 Mar. 12, 2015

(30) Foreign Application Priority Data

Apr. 2, 2012 (JP) ..... 2012-084358

(51) Int. Cl.
*B67D 7/60* (2010.01)
*B65D 83/00* (2006.01)
(Continued)

(52) U.S. Cl.
CPC .... *B65D 83/0005* (2013.01); *B05C 17/00576* (2013.01); *B05C 17/00596* (2013.01); *B05C 17/015* (2013.01)

(58) Field of Classification Search
CPC ..... B65D 83/0005; B65D 83/64; B05C 17/00576; B05C 17/00596; B05C 17/015; B05C 17/00579
(Continued)

(56) References Cited

U.S. PATENT DOCUMENTS 3,066,836 A * 12/1962 Trumbull ..... B05C 17/00576 222/327
3,380,383 A * 4/1968 Schnepfe, Jr. ..... F42B 12/50 102/368
(Continued)

FOREIGN PATENT DOCUMENTS

DE 3718948 A1 12/1988
EP 2108599 A1 10/2009
(Continued)

OTHER PUBLICATIONS

Extended European Search Report and claims from EP 11819768.
(Continued)

*Primary Examiner* — Patrick M Buechner
(74) *Attorney, Agent, or Firm* — J-TEK Law PLLC; Jeffrey D. Tekanic; Scott T. Wakeman

(57) ABSTRACT

A plunger is fittable within a cylinder of a pneumatic dispenser that discharges a viscous material. The plunger has a first portion located at the front, and a second portion located at the rear. The second portion is a hollow structure and has a circumferential wall. An inner circumferential surface of this circumferential wall has a tapered surface. The circumferential wall has a thickness dimension that decreases in the axial direction moving away from the first portion. Therefore, the circumferential wall easily displaces in the radial direction, because the bending stiffness decreases in the axial direction moving away from the first portion. The first portion is a solid structure that is more rigid than the second portion. The first portion also has a partition
(Continued)

wall surface that separates the inner chamber of the second portion from the solid section of the first portion.

23 Claims, 9 Drawing Sheets

(51) Int. Cl.
*B05C 17/015* (2006.01)
*B05C 17/005* (2006.01)

(58) Field of Classification Search
USPC ..... 222/389
See application file for complete search history.

(56) References Cited

U.S. PATENT DOCUMENTS 3,407,974 A * 10/1968 Chmielowiec ..... B65D 83/62 222/386.5
4,108,219 A * 8/1978 Shulsinger ..... B65D 83/64 141/20
4,109,833 A * 8/1978 Gross ..... B65D 83/0005 222/386.5
4,355,736 A * 10/1982 Schumacker ..... B65D 83/64 222/386.5
4,704,105 A 11/1987 Adorjan et al.
4,840,293 A 6/1989 Segatz
4,854,485 A * 8/1989 Collins ..... B05C 17/00576 222/327
4,877,156 A * 10/1989 Clanet ..... B65D 83/64 222/386.5
4,986,444 A 1/1991 Corso
5,242,091 A 9/1993 Ishida et al.
5,360,146 A * 11/1994 Ikushima ..... B05C 17/00576 222/326
5,547,107 A 8/1996 Boiardi
5,680,967 A 10/1997 Dang et al.
6,334,553 B1 * 1/2002 Bouras ..... B05C 11/10 222/386
6,655,555 B1 12/2003 Yankoglu et al.
6,681,810 B2 1/2004 Weston
7,222,646 B2 * 5/2007 Gupta ..... B65D 83/64 141/2
7,458,487 B1 * 12/2008 Ikushima ..... B05C 17/00576 222/262
7,878,377 B2 2/2011 Ikushima
9,126,702 B2 9/2015 Mizoguchi et al.
9,309,042 B2 * 4/2016 Digregorio ..... B65D 83/0005
9,340,306 B2 5/2016 Mizoguchi et al.
2004/0007598 A1 * 1/2004 Barrett ..... B05C 17/00579 222/386
2008/0041885 A1 * 2/2008 Costa ..... A61M 5/31511 222/386
2009/0026226 A1 1/2009 Ikushima
2009/0198182 A1 8/2009 Fujishima et al.
2010/0147896 A1 6/2010 Obrist
2011/0254187 A1 10/2011 Mizoguchi et al.
2012/0205001 A1 8/2012 Mizoguchi et al.
2015/0069091 A1 * 3/2015 Mizoguchi ..... B05C 17/015 222/389
2015/0336690 A1 11/2015 Mizoguchi et al.
2016/0221696 A1 8/2016 Mizoguchi et al.

FOREIGN PATENT DOCUMENTS

EP 2108599 B1 12/2010
FR 1228986 A 9/1960
GB 2071268 A 9/1981
JP S58-981 U 1/1983
JP S60500045 1/1985
JP S61171565 A 8/1986
JP S6333202 A 2/1988
JP H04200672 A 7/1992
JP H0557870 A 3/1993
JP H05200343 A 8/1993
JP 5254580 A 10/1993
JP 642800 U 6/1994
JP H06283856 A 10/1994
JP H07106331 B2 11/1995
JP H11104404 A 4/1999
JP 3073311 U 11/2000
JP 2000317370 11/2000
JP 2000344282 A 12/2000
JP 2002080005 A 3/2002
JP 2004037935 A 2/2004
JP 2004321985 A 11/2004
JP 2007176536 A 7/2007
JP 2010042361 A 2/2010
JP 4659128 B1 3/2011
JP 2013212878 A 10/2013
JP 5651803 B1 1/2015
WO 9849994 A 11/1998

OTHER PUBLICATIONS

International Preliminary Report on Patentability from PCT/JP2012/080786.
International Search report and claims from PCT/JP2012/080786.
Office Action and partial English translation from related application JP 2012-084358.
Office Action mailed Mar. 11, 2015 in related U.S. Appl. No. 13/501,750, including examined claims 1-8.
Office Action mailed Sep. 6, 2016 in related Japanese patent application No. 2015-236518, including machine translation generated by the Global Dossier and a human-translation of claim 1 examined in the Japanese Office Action.

* cited by examiner

| | | |
|---|---|---|
| S1 | PREPARE VISCOUS MATERIAL | |
| | S11 | MIX |
| | S12 | AGITATE AND DEGAS |
| S2 | FILL WITH VISCOUS MATERIAL | |
| | S21 | PREPARE CONTAINER SET |
| | S22 | HOLD CONTAINER SET |
| | S23 | PREPARE CARTRIDGE |
| | S24 | HOLD CARTRIDGE |
| | S25 | INSERT ROD |
| | S26 | EXTRUDE |
| | S27 | ASSIST UPWARD DISPLACEMENT OF ROD |
| | S28 | RETRACT ROD |
| | S29 | REMOVE CARTRIDGE |
| | S30 | REMOVE CONTAINER SET |

FIG.9

PLUNGER FOR PNEUMATIC DISPENSER

CROSS-REFERENCE

This application is the US national stage of International Patent Application No. PCT/JP2012/080786 filed on Nov. 28, 2012, which claims priority to Japanese Patent Application No. 2012-084358 filed on Apr. 2, 2012.

TECHNICAL FIELD

The invention relates to plungers that are used by being fitted into a cylinder of a pneumatic dispenser that discharges a viscous material by using pressurized air.

BACKGROUND ART

Fields are already known that deal with viscous materials. Such applications include sealants for mechanical or electrical components, adhesives, pastes for use in forming electrical or electronic circuits, solders for use in mounting electronic components, etc. Such viscous materials are used in the aerospace industry, the electrical industry, the electronics industry, etc.

In order to apply a viscous material to a desired target, a pneumatic dispenser is used that discharges the viscous material by using pressurized air. In this type of pneumatic dispenser, a plunger or a piston is fitted in a cylinder.

In order to discharge the viscous material towards a desired target using a pneumatic dispenser of this type, it is first necessary to fill the cylinder of the pneumatic dispenser with the viscous material. Following the filling, the viscous material is discharged towards the desired target by applying pressure to the plunger in the pneumatic dispenser.

Patent Document No. 1, which relates to a Japanese Patent Application filed by the same Applicant, discloses some conventional examples of detachable cartridges for use in pneumatic dispensers of this kind, i.e. a unit assembled by fitting a plunger within a cylinder, and some conventional examples of an apparatus and a method that fill a viscous material from a discharge port of the cylinder into the cylinder. In addition, Patent Document No. 2 discloses a conventional example of a pneumatic dispenser of this type.

PRIOR ART REFERENCES

Patent Documents

Patent Document No. 1: Japanese Patent No. 4659128

Patent Document No. 2: Japanese Kokoku Patent Publication No. H07-106331

SUMMARY OF THE INVENTION

The co-inventors repeatedly performed experiments in which a viscous material is filled into a conventional cartridge assembled by fitting a conventional plunger in a cylinder, and after completion of the filling, the cartridge is attached to a pneumatic dispenser and the viscous material is discharged from the pneumatic dispenser.

As a result, the co-inventors obtained the following insights. That is, in the filling stage, it is important to simultaneously fulfill: the need (intended air venting) to vent air, which is present in a filling chamber of a cartridge to be filled with a viscous material, by passing through a clearance between a plunger and a cylinder, and the need (viscous material leakage prevention) to prevent the viscous material from leaking from the filling chamber due to a reduction in the air-tightness between the plunger and the cylinder as a result of the plunger deforming by the forces exerted on the plunger from the viscous material contacting it (e.g., caused by insufficient stiffness of the plunger).

In addition, in the discharging stage, it is important to simultaneously achieve: the need (pressurized air leakage prevention) to prevent the viscous material from failing to be discharged from the pneumatic dispenser because of leakage of the pressurized air from the plunger due to a reduction in the air-tightness between the plunger and the cylinder as a result of the plunger deforming by forces exerted from the pressurized air that is charged into the plunger (e.g., caused by the insufficient stiffness of the plunger), and the need (pressurized air leakage prevention) to prevent the ingress of the pressurized air into the filling chamber because of leakage between the plunger and the cylinder due to a reduction in the air-tightness between the plunger and the cylinder as a result of the plunger deforming by forces exerted from the pressurized air that is charged into the plunger (e.g., caused by insufficient flexibility of the plunger), due to manufacturing variations in the dimensions in the plunger or the cylinder, etc.

Based upon the above-described insights, the invention has been created for the purpose of providing a plunger for use by being fitted in a cylinder of a pneumatic dispenser that discharges a viscous material by using pressurized air that, in the filling stage of the viscous material into the cylinder, achieves the intended venting and prevents the unintended leakage of the viscous material, and in the discharge stage of the viscous material from the pneumatic dispenser, prevents the unintended leakage of the pressurized air.

According to the present invention, the following modes are provided. These modes will be stated below such that these modes are divided into sections and are numbered, and such that these modes depend upon other mode(s), where appropriate. This facilitates a better understanding of some of the plurality of technical features and the plurality of combinations thereof disclosed in this specification, and does not mean that the scope of these features and combinations should be interpreted to limit the scope of the following modes of the invention. That is to say, it should be interpreted that it is allowable to select the technical features, which are stated in this specification but which are not stated in the following modes, as technical features of the invention.

Furthermore, reciting herein each one of the selected modes of the invention in a dependent form so as to depend from the other mode (s) does not exclude the possibility of the technical features in the dependent-form mode from becoming independent of those in the corresponding dependent mode(s) and to be removed therefrom. It should be interpreted that the technical features in the dependent-form mode(s) may become independent according to the nature of the corresponding technical features, where appropriate.

(1) A plunger for use by being fitted in a cylinder of a pneumatic dispenser that discharges a viscous material by using pressurized air, wherein an inner chamber of the cylinder is divided by the fitting of the plunger therein into a first sub-chamber that stores the viscous material and a second sub-chamber into which the pressurized air is charged, which sub-chambers are coaxially aligned with respect to each other, the end, from among the two ends of the cylinder, that communicates with the first sub-chamber includes a discharge port for discharging the viscous material, the plunger has a first portion in contact with the first sub-chamber and a second portion in contact with the second sub-chamber, which first and second portions are coaxially aligned with respect to each other, each of the first sub-chamber and the second sub-chamber extends coaxially with the cylinder by having a cross section having a silhouette representing a generally circular shape, the second portion is a hollow structure having a circumferential wall that is coaxially aligned with the cylinder, the circumferential wall serves as an elastic structure that is elastically deformable in a radial direction of the plunger, an inner circumferential surface of the circumferential wall has a tapered surface tapered so as to increase in diameter in the axial direction moving away from the first portion, the circumferential wall has a thickness dimension that decreases in the axial direction moving away from the first portion, whereby the circumferential wall more easily displaces in the radial direction by decreasing the bending stiffness in the axial direction moving away from the first portion, the first portion is a solid structure having a thicker wall thickness than the second portion, and serving as a relatively rigid structure with respect to the second portion, and the first portion has a partition wall surface that separates an inner chamber of the second portion from a solid section of the first portion.

(2) A plunger for use by being fitting into a cylinder of a pneumatic dispenser that discharges a viscous material by using pressurized air, wherein an inner chamber of the cylinder is divided by the fitting of the plunger therein into a first sub-chamber that stores the viscous material and a second sub-chamber into which the pressurized air is charged, which sub-chambers are coaxially aligned with respect to each other, the end, from among the two ends of the cylinder, that communicates with the first sub-chamber includes a discharge port for discharging the viscous material, the plunger has a first portion in contact with the first sub-chamber and a second portion in contact with the second sub-chamber, which first and second portions are coaxially aligned with respect to each other, each of the first sub-chamber and the second sub-chamber extends coaxially with the cylinder by having a cross section having a silhouette representing a generally circular shape, the second portion is a hollow structure having a circumferential wall that is coaxially aligned with the cylinder, the circumferential wall serving as an elastic structure that is elastically deformable in a radial direction of the plunger, the first portion has a thicker wall thickness than the second portion, and serving as a relatively rigid structure with respect to the second portion, an outer circumferential surface of the first portion has a first annular groove and a first land, which extend circumferentially about an axis of the plunger, the first portion at the first land locally opposes an inner circumferential surface of the cylinder, the first land has a radial clearance with the inner circumferential surface of the cylinder such that venting is achieved by allowing the flow of air, which is within the first sub-chamber, from the first sub-chamber to the second sub-chamber, and viscous-material blockage is achieved by substantially preventing the flow of the viscous material from the first sub-chamber to the second sub-chamber by using the viscosity of the viscous material, the first land serving as a stationary land that is not displaced in the radial direction with respect to the axis of the plunger, an outer circumferential surface of the second portion has a second annular groove and a second land, which extend circumferentially about the axis of the plunger, the second portion at the second land is locally in contact with the inner circumferential surface of the cylinder, and the second land is substantially in contact with the inner circumferential surface of the cylinder such that said air venting, said viscous-material blockage, and air leakage prevention that substantially prevents pressurized air, which is within the second sub-chamber, from flowing from the second sub-chamber to the first sub-chamber by leaking between the second land and the cylinder are achieved, the second land serving as a movable land that displaces in the radial direction with respect to the axis of the plunger.

(3) The pneumatic-dispenser plunger according to mode (2), wherein the circumferential wall has a thickness dimension that decreases in the axial direction moving away from the first portion, whereby the circumferential wall more easily displaces in the radial direction by the decrease in the bending stiffness in the axial direction moving away from the first portion.

(4) The pneumatic-dispenser plunger according to mode (3), wherein an inner circumferential surface of the circumferential wall is tapered so as to increase in diameter in the axial direction moving away from the first portion, and an outer circumferential surface of the circumferential wall is non-tapered.

(5) The pneumatic-dispenser plunger according to any one of modes (2)-(4), further having a deflector, which is on an interior side of the circumferential wall and has a work surface that is inclined with respect to the axis of the plunger, wherein when the flow of the pressurized air impinges on the work surface during operation of the pneumatic dispenser, the deflector generates, from the flow of the pressurized air, forces in directions that cause circumferential wall to radially expand, and directs the forces onto the circumferential wall surface.

(6) The pneumatic-dispenser plunger according to any one of modes (2)-(5), wherein the first portion is a solid structure having a thicker wall thickness than the second portion, and the first portion has a partition wall surface that separates an inner chamber of the second portion from a solid section of the first portion.

(7) The pneumatic-dispenser plunger according to any one of modes (2)-(6), further having a third land extending along an annular boundary between the first land and the second land, wherein the third land has a radial clearance with the inner circumferential surface of the cylinder, such that said venting and said viscous-material blockage are achieved, and the third land, the first land and the second land of the plunger each locally oppose to the inner circumferential surface of the cylinder.

(8) The pneumatic-dispenser plunger according to any one of modes (1)-(7), wherein an axial dimension representative of the plunger is approximately 70% or greater than a diameter representative of the same plunger.

(9) The pneumatic-dispenser plunger according to any one of modes (1)-(8), wherein a surface of the plunger is coated with a synthetic resin having less adhesiveness than the surface of the plunger, whereby it is possible to reuse the plunger by removing the viscous material attached thereto by washing.

The invention optimizes the shape of a plunger so that, in the filling stage of the viscous material, the intended venting can be achieved and unintended leakage of the viscous material can be prevented, and in the discharge stage of the viscous material, unintended leakage of the pressurized air can be prevented.

BRIEF DESCRIPTION OF THE DRAWINGS

FIG. 9 is a process flowchart illustrating the filling method, along with a viscous-material preparation method performed prior to the filling method.

EMBODIMENTS FOR CARRYING OUT THE INVENTION

Some of the more specific and illustrative embodiments of the invention will be described in the following in more detail with reference to the drawings.

Figure 1:
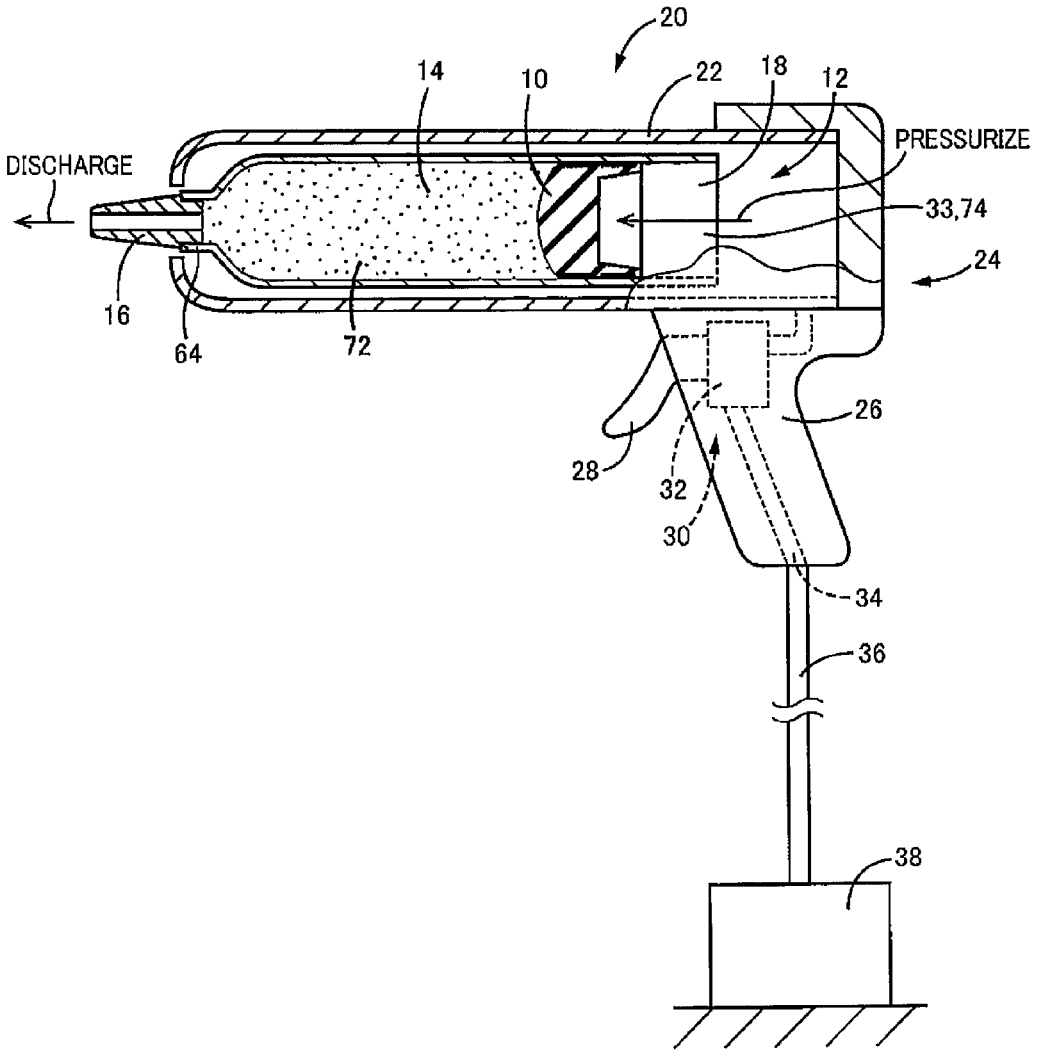
FIG. 1 a cutaway cross-sectional side view illustrating a cartridge using a plunger according to an illustrative embodiment of the invention, when the cartridge is loaded in a pneumatic dispenser.

Referring to FIG. 1, a cartridge 12 is illustrated in a cutaway cross-sectional side view, which is constructed by fitting a plunger 10 according to an embodiment of the invention in a cylinder 18. The cartridge 12 is illustrated in a state (an assembled state and an active state) in which the cylinder 18 has been pre-filled with a viscous material 14, a discharge nozzle 16 is detachably attached to the distal tip end of the cylinder 18, and the cartridge 12 is detachably loaded in a hand-held dispenser 20 (it is possible to be of a gun type depicted in FIG. 1 or of a straight type).

Describing first the dispenser 20, as illustrated in FIG. 1, the dispenser 20 has a cylindrical retainer 22 and a main body 24 that is detachably attached to the retainer 22. The main body 24 has a handle 26, which can be griped by an operator, and a trigger 28 (an example of a manipulation element in the form of any of a lever, a switch, a button, or the like) that is attached so as to be movable relative to the handle 26.

The main body 24 further has an air-pressure control unit 30. The air-pressure control unit 30 has a valve 32 operated by the trigger 28; the valve 32 selectively and fluidly connects a chamber 33 located behind the plunger 10 with a hose connection port 34. A high-pressure source 38 that supplies pressurized air is coupled to the hose connection port 34 via a flexible hose 36.

If the trigger 28 is pulled by the operator, then the valve 32 shifts from a closed position to an open position, thereby allowing the pressurized air to enter the chamber 33 through the valve 32. If the pressurized air impinges against the rear of the plunger 10, then the plunger 10 advances relative to the cylinder 18 (in FIG. 1, is moved leftwards), thereby discharging the viscous material 14 from the cylinder 18. An example of the viscous material 14 is a high-viscosity, electrically non-conductive sealant; an example of the use of such seals of aircraft components.

Figure 2:
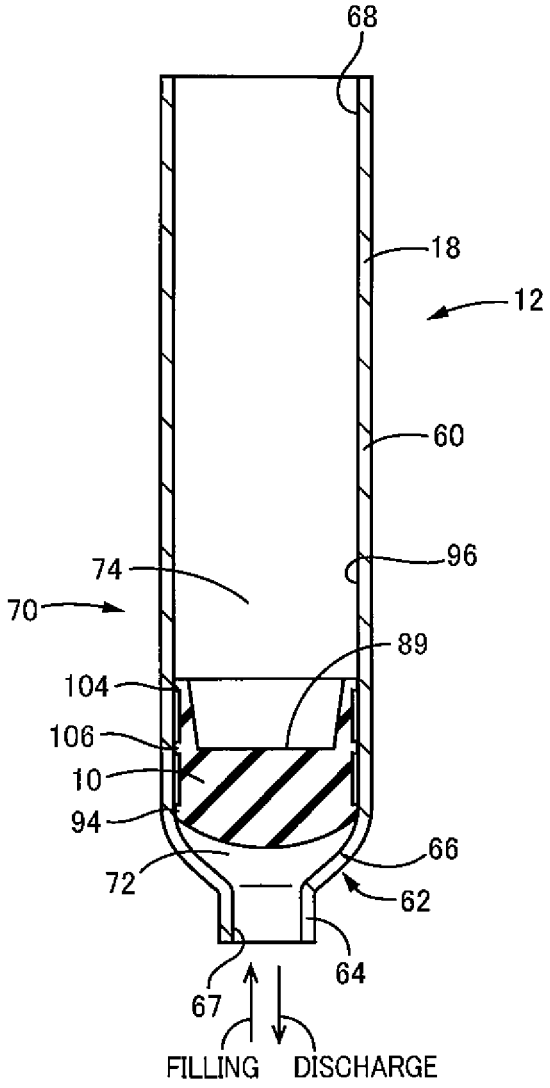
FIG. 2 is a cross-sectional side view illustrating the cartridge depicted in FIG. 1.

Next, describing the cartridge 12 schematically, as illustrated in the cross-sectional side view of FIG. 2, the cartridge 12 is configured by fitting the plunger 10 in the cylinder 18. The plunger 10 is formed using a synthetic rubber (e.g., NBR) as a single material, through injection molding, so as to form a unitary component, serving as a so-called piston in the cartridge 12. The material of synthetic rubbers is less stiff and instead more elastic than synthetic resins such as PP (polypropylene). The material of the plunger 10, however, may be replaced with PP, a material substantially equal in elasticity to PP, or a material more elastic than PP.

Describing next the cylinder 18 in more detail, the cylinder 18 has a cylindrical inner chamber 70, within which the plunger 10 is detachably fitted in substantially air-tight and axially slidable manner.

More specifically, the cylinder 18 has a cylindrical main body portion 60 extending straight in a uniform cross-section, and a hollow base portion 62 coupled to one of the two ends of the main body portion 60, in a coaxial alignment with respect to each other. At its tip end, the base portion 62 has a tubular portion 64 that is smaller in diameter than the main body portion 60, and the base portion 62 has a tapered portion 66 at the connection side with the main body portion 60. A through-hole in the tubular portion 64 forms a discharge port 67 of the cylinder 18, which is detachably attached to a discharge nozzle 16 (e.g., via a threaded connection), as illustrated in FIG. 1. The opposite end of the main body portion 60 is an opening 68. One example of the material constituting the cylinder 18 is PP (polypropylene), but it is not limited to this.

In the present embodiment, the viscous material 14 is filled from the outside (the container 112 depicted in FIG. 5) into the cartridge 12 by passing through the discharge port 67 of the cartridge 12; after completion of the filling, the viscous material 14 is discharged from the cartridge 12 to dispense the viscous material 14 for use by passing through the same passage, i.e. a passage within the discharge port 67 (the smallest-diameter passage of the cylinder 18). In other words, the flow of the viscous material 14 into and out of the cartridge 12 is carried out by passing through the discharge port 67, which is the smallest-diameter passage.

As illustrated in FIG. 2, the inner chamber 70 of the cylinder 18 is divided by the plunger 10, into a first sub-chamber 72 that stores the viscous material 14 and a second sub-chamber 74 into which the pressurized air is introduced, both of which are coaxially aligned. The first sub-chamber 72 is in communication with the discharge port 67, while the second sub-chamber 74 is connected to the high-pressure source 38 via the valve 32, as illustrated in FIG. 1.

Figure 3A:
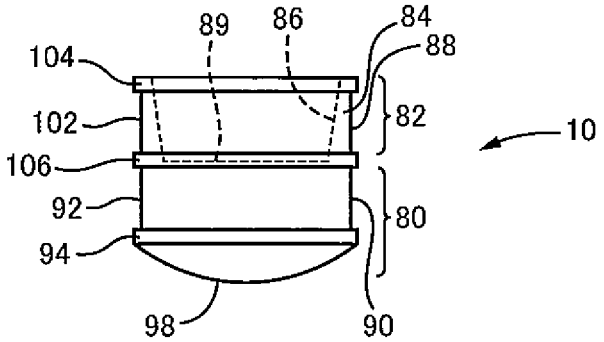
FIG. 3A is a side view illustrating the plunger depicted in FIG. 1.
Figure 3B:
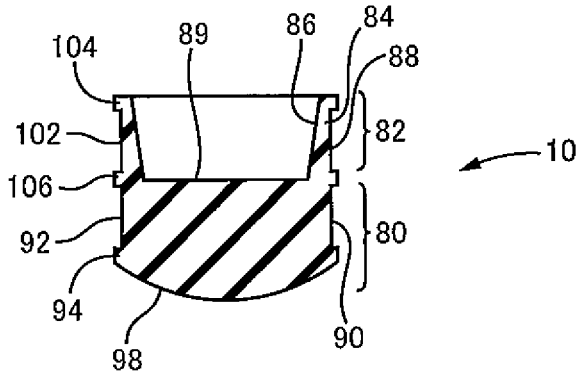
FIG. 3B is a cross-sectional view illustrating the plunger depicted in FIG. 1.

Describing next the plunger 10 in more detail, as illustrated in FIG. 3, the plunger 10 has a first portion 80 in contact with the first sub-chamber 72, and a second portion 82 in contact with the second sub-chamber 74, both of which are coaxially aligned with respect to each other and coupled to each other. The first sub-chamber 80 axially extends, while defining a cross section in a shape of a generally circular silhouette. Similarly, the second sub-chamber 82 axially extends, while defining a cross section in a shape of a generally circular silhouette.

The first portion 80 is solid, while the second portion 82 is hollow, which defines a hollow circumferential wall 84 coaxially aligned with the cylinder 18, the circumferential wall 84 having an inner circumferential surface 86 and an outer circumferential surface 88. The second portion 82 serves as an elastic structure such that, in response to radially outwardly directed forces, it elastically radially expands in the same direction as those of the forces, while, in response to radially inwardly directed forces, it elastically radially contracts in the same direction as those of the forces. As opposed to the second portion 82, the first portion 80, however, is solid, and serves as a rigid structure relative to the second portion 82, because it has a thickness that is larger than the second portion 82. In other words, the first portion 80 is a solid structure, a more-highly stiff structure and a less-elastic structure, while the second portion 82 is a hollow structure, a less-stiff structure and a more-elastic structure.

The first portion 80 has a partition wall surface 89 that separates an inner chamber of the second portion 82 from a solid section of the first portion 80. The partition wall surface 89 is a flat plane that is perpendicular to the axis of the plunger 10 and faces in the direction of the second portion 82.

The circumferential wall 84 has a thickness dimension that decreases in the axial direction moving away from the first portion 80, whereby the circumferential wall 84 becomes more easily elastically deformable in the diametric direction due to the bending stiffness decreasing in the axial direction moving away from the partition wall surface 89 of the first portion 80. More specifically, the inner circumferential surface 86 of the circumferential wall 84 is a tapered surface that increases in diameter in the direction moving away from the partition wall surface 89 of the first portion 80, and the outer circumferential surface 88 of the circumferential wall 84 is non-tapered.

An outer circumferential surface 90 of the first portion 80 has a wider first annular groove 92 and a narrower first land (annular ridge) 94, which are coaxially aligned with respect to each other. The diameter of a circle representing a cross section of a base surface of the first annular groove 92 is larger than the diameter of a circle representing a cross section of a top surface of the first land 94. In addition, the width of the first annular groove 92, i.e. the dimension of the first annular groove 92, which is measured along the axis of the plunger 10 is longer than the width of the first land 94, i.e. the dimension of the first land 94, which is measured along the axis of the plunger 10.

When the plunger 10 is inserted in the cylinder 18, the outer circumferential surface 90 of the first portion 80 does not oppose the inner circumferential surface 96 of the cylinder 18 as a whole, but opposes only locally at the first land 94. The first land 94 has a radial clearance (hereinafter, referred to as "first clearance CL1") with the inner circumferential surface 96 of the cylinder 18 so that air, which is present in the first sub-chamber 72, is allowed to flow towards the second sub-chamber 74 and be vented, and a viscous-material block that substantially blocks the flow of the viscous material 14 in the same direction can be achieved by utilizing the viscosity of this viscous material 14.

In other words, the first land 94, in operation, permits air to flow between the first sub-chamber 72 and the second sub-chamber 74 in either direction, but hinders the viscous material 14 from flowing between the first sub-chamber 72 and the second sub-chamber 74 in either direction.

The first portion 80 further has a tip end 98 in the shape of a convex curved surface, and the tip end 98 is shaped to partially complement an inner circumferential surface (concaved curved surface) of the tapered portion 66 of the base portion 62 of the cylinder 18, as illustrated in FIG. 2. If, alternatively, the tip end 98 is designed to substantially entirely complement the inner circumferential surface of the tapered portion 66, then, when the plunger 10 bottoms out in the cylinder 18, the amount of the viscous material 14 remaining in the cylinder 18 is substantially zero; as a result, the cartridge 12 can discharge the viscous material 14 that was filled therein substantially without waste. The tip end 98 is located adjacent to the first land 94, without creating any axial clearance therebetween.

The outer circumferential surface 88 of the second portion 82 has a wider second annular groove 102 and a narrower second land (annular ridge) 104, which are coaxially aligned with respect to each other. The diameter of a circle representing a cross section of a base surface of the second annular groove 102 is larger than the diameter of a circle representing a cross section of a top surface of the second land 104. In addition, the width of the second annular groove 102 is greater than that of the second land 104.

When the plunger 10 is inserted into the cylinder 18, the outer circumferential surface 88 of the second portion 82 does not oppose the inner circumferential surface 96 of the cylinder 18 as a whole, but only locally at the second land 104. The second land 104 has a radial clearance (hereinafter, referred to as "second clearance CL2") with the inner circumferential surface 96 of the cylinder 18, to achieve the aforementioned air venting, the aforementioned viscous-material blocking, and an air leak prevention that substantially blocks a flow towards the first sub-chamber 72 due to pressurized air within the second sub-chamber 74 leaking from between the second land 104 and the cylinder 18. The second land 104 is located at a rear end of the plunger 10.

In other words, the second land 104, in operation, provides a non-return function by permitting a flow from the first sub-chamber 72 towards the second sub-chamber 74 so that a flow in the reverse direction is inhibited, and further inhibits the viscous material 14 to flow between the first sub-chamber 72 and the second sub-chamber 74 in either direction.

The plunger 10 further has a third land (annular ridge) 106 extending along an annular boundary between the first land 80 and the second land 82. The third land 106 is larger in diameter than the first annular groove 92 and the second annular groove 102. The third land 106 is generally centered in the axial length between the first land 94 and the second land 96. The third land 106 has a radial clearance (hereinafter, referred to as "radial third clearance CL3") with the inner circumferential surface 96 of the cylinder 18, to achieve the aforementioned air venting and the aforementioned viscous-material blocking.

Increasing the air tightness between the second land 104 and the inner circumferential surface 96 of the cylinder 18 is important, in particular, in improving the aforementioned air leak prevention. Because the second land 104, unlike the first land 94, is elastically deformable in radial direction with greater ease, the second land 104, prior to the insertion into the cylinder 18, has an outer diameter slightly larger than the actual value of the inner diameter of the cylinder 18 (e.g., the maximum value in the range of variations of the inner diameter (the maximum value among varying inner diameters measured in a direction that allows the radial clearance to radially increase). The second land 104, when being fitted within the cylinder 18, is reduced in diameter by elastically deforming radially inwardly and matches the actual inner diameter of the cylinder 18; as a result, an interference fit is achieved. As a result of this, the radial clearance therebetween (i.e., the second radial clearance CL2) becomes substantially zero, and a high level of air-tightness between the plunger 10 and the cylinder 18 is realized.

Thus, the second land 104 serves as a movable land that, because of its radial elastic deformation, functions to accommodate variations of the inner diameter of the cylinder 18, while the first land 94, which is substantially a rigid structure, serves as a fixed land that does not have a variable accommodation function. Due to this, the first land 94 is designed so as to have an outer diameter smaller than the inner diameter of the cylinder 18 and the outer diameter of the second land 104 in order to prevent the first land 94 from excessively interfering with the cylinder 18 of any actual dimension.

Now, the dimensions of the outer diameters of the plunger 10 will be described in more detail.

Before insertion of the plunger 10 into the cylinder 18 (just after the manufacture, that is, a free state in which no external forces are acting on it), the relationship between the diameter D1 of the first land 94 and the diameter D2 of the second land 104 is:

$$D2>D1.$$

In addition, in the state that the plunger 10 has been inserted into the cylinder 18, because the second land 104 has been forced to elastically contract by the inner diameter of the cylinder 18, D2 decreases; as a result, the second clearance CL2 reduces to zero, except at the time when the aforementioned air venting is performed. In contrast, even after the plunger 10 has been inserted into the cylinder 18, because the first land 94 is not brought into contact with the inner circumferential surface 96 of the cylinder 18, D1 remains unchanged; therefore the first clearance CL1 remains unchanged. Thus, even in the state that the plunger 10 has been inserted in the cylinder 18, the following relationship is maintained:

$$D2>D1.$$

In addition, the outer diameter D3 of the third land 106 is substantially the same as the outer diameter D1 of the first land 94. In other words, regardless of whether it is before or after the insertion of the plunger 10 into the cylinder 18, the following relationship is substantially established:

$$D3=D1.$$

Now, the aspect ratio (height-width ratio) of the plunger 10 when viewed in side elevation will be described.

The axial-dimension that represents the plunger 10 (e.g., the axial dimension from an edge position of a front end of the first land 94 to an edge position of a rear end of the second land 104) is larger than or equal to approximately 70% of the diametric dimension that represents the same plunger 10 (e.g., the outer diameter of the second land 104). This dimensional effect reduces the tendency that the pressurized air will leak into the first sub-chamber 72 by passing between the plunger 10 and the cylinder 18 due to the radial clearance enlarging by the plunger 10 unintentionally tilting in the cylinder 18 at the time the pressurized air is acting on it. The aspect ratio representative of the ratio of the axial-dimension that represents the plunger 10 to the diametric dimension that represents the same plunger 10 may be greater than or equal to approximately 100% or approximately 150%; the higher the aspect ratio, the greater the anti-tilt effect on the plunger 10 in the cylinder 18.

In addition, the first portion 80 of the plunger 10 has the material-property-related effect that the first portion 80 is stiffer and less elastically-deformable than the second portion 82; because of this, the shape retention capabilities of the plunger 10 with respect to external forces is improved; as a result, tilting of the plunger 10 in the cylinder 18 due to external forces is reduced.

Now, the functions provided by the plunger 10 will be described in a divided manner, i.e., in the filling stage that fills the viscous material 14, and in the discharging stage in which the filled viscous material 14 is discharged from the cartridge 12 using the pneumatic dispenser 20.

First, the functions provided by the plunger 10 in the filling stage will be described.

As illustrated in FIG. 2, the filling of the viscous material 14 into the cartridge 12 is carried out by loading the viscous material 14 into the first sub-chamber 72 of the cartridge 12 from the discharge port 67. When the viscous material 14 is being loaded into the first sub-chamber 72, air within the first sub-chamber 72 is compressed by the viscous material 14; as a result, the pressure of the air within the first sub-chamber 72 is higher than the pressure of the air within the second sub-chamber 74 (in the filling stage this pressure is equal to atmospheric pressure), thereby generating a pressure difference between the first sub-chamber 72 and the second sub-chamber 74. Owing to this pressure difference, air within the first sub-chamber 72 (air that has been compressed by the viscous material 14) flows out to the second sub-chamber 74 bypassing through the radial clearances CL1, CL2 and CL3 between the plunger 10 and the cylinder 18.

Incidentally, at the time that the filling of the viscous material 14 into the first sub-chamber 72 is completed, the presence of air in the first sub-chamber 72 is undesirable. In case air is present within the first sub-chamber 72 when the viscous material 14 will be discharged from the first sub-chamber 72 by the pneumatic dispenser 20, at some time, air, and not the viscous material 14, will be discharged from the first sub-chamber 72. In that case, it is possible that air will have been unintentionally entrapped in the viscous material 14 that has been applied to the target object.

As described above, because the aforementioned venting is possible via any one of the first land 94, the second land 104 and the third land 106, air within the first sub-chamber 72 is expelled into the second sub-chamber 74 during the filling of the viscous material 14 into the first sub-chamber 72. As a result, at the moment that the filling of the viscous material 14 into the first sub-chamber 72 has been completed, the presence of air in the first sub-chamber 72 is prevented.

When the viscous material 14 is being filled into the first sub-chamber 72 from a container 112, which will be described in detail below with reference to FIG. 5, it is possible that the viscous material 14 within the first sub-chamber 72 will be forcibly pressed against the plunger 10. When the viscous material 14 is pressed so forcibly against the plunger 10 that the plunger 10 is deformed by the force exerted on the plunger 10 when it is being pressed, the radial clearances CL1, CL2 and CL3 between the plunger 10 and the cylinder 18 expand; as a result, there is a possibility that the viscous material 14 will flow from the first sub-chamber 72 to the second sub-chamber 74.

Because the plunger 10 is entirely formed by a rubber, the plunger 10 is more elastically deformable than if it had been entirely formed by a synthetic resin such as polypropylene. Nevertheless, by making the portion within the plunger 10, which is permitted to be stiffer (the portion where the air tightness may be decreased between it and the cylinder 18), i.e. the first portion 80, solid, it has a higher stiffness than the second portion 82.

As a result, even when the viscous material 14 in the first sub-chamber 72 is forcibly pressed against the face of the tip end 98 of the first portion 80, the first portion 80, owing to its increased stiffness, experiences almost no elastic deformation. Therefore, the first land 94 experiences no deformation and the first clearance CL1 experiences no local deformation; as a result, the viscous material 14 is prevented from flowing from the first sub-chamber 72 to the second sub-chamber 74.

Additionally, the first portion 80 serves as a partition that separates the viscous material 14 in the first sub-chamber 72 from the second portion 82. As a result, owing to the first portion 80 that intervenes, the influence of the pressure of the first sub-chamber 72 does not reach the second portion 82, and the second portion 82 does not undergo elastic deformation. Therefore, the second land 104 does not deform and the second clearance CL2 does not locally expand; as a result, the viscous material 14 is prevented from flowing out from the first sub-chamber 72 to the second sub-chamber 74.

When the viscous material 14 is filled from the container 112 into the first sub-chamber 72, it is possible that the viscous material 14 within the first sub-chamber 72 will pass through the first clearance CL1 between the first land 94 and the cylinder 18. However, even if the viscous material 14 within the first sub-chamber 72 tries to pass through the first clearance CL1, it is blocked in the first clearance CL1 by clogging due to its own viscosity, and the viscous material 14 does not enter the second sub-chamber 74.

Even if the viscous material 14 passes through the first clearance CL1, because it will be blocked by clogging in the third clearance CL3 (same dimensions as the first clearance CL1) between the third land 106 and the cylinder 18, the viscous material 14 does not enter the second sub-chamber 74.

In addition, even if the viscous material 14 passes through the third clearance CL3, because it will be blocked by clogging in the second clearance CL2 (thinner than the first clearance CL1 and the third clearance CL3) between the second land 104 and the cylinder 18, the viscous material 14 does not enter the second sub-chamber 74.

Thus, with respect to the viscous material 14, the triple viscous material blockage by the first land 94, the third land 106 and the second land 104, which are arranged in series in the axial direction, prevents the flow of viscous material 14 from the first sub-chamber 72 into the second sub-chamber 74.

Figure 4A:
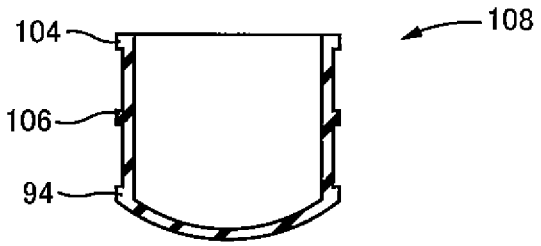
FIG. 4A is a cross-sectional view illustrating a thin-walled plunger as a comparative example of the plunger depicted in FIG. 1.

The inventors conducted experiments for evaluating the results provided by the plunger 10, which prevent the viscous material 14 from leaking from between the plunger 10 and the cylinder 18 in the filling stage. These experiments include a first experiment wherein the filling was performed using the plunger 10 depicted in FIG. 3, and a second experiment wherein the filling was performed using a thin-walled plunger 108 serving as a comparative example and depicted in FIG. 4A.

The thin-walled plunger 108 was produced by injection molding using the same material as that of the plunger 10, but the thin-walled plunger 108 is different from the plunger 10 in that the thin-walled plunger 108 does not have any solid section (the content of the first portion 80) or a tapered surface (the inner circumferential surface 86 of the second portion 82), and it has an entirely uniform thickness.

Describing first the experimental conditions, both the first experiment and the second experiment were conducted using a two-part viscous material 14 as described below, and using a filling device 210 that will be described below with reference to FIGS. 6-9.

Figure 4B:
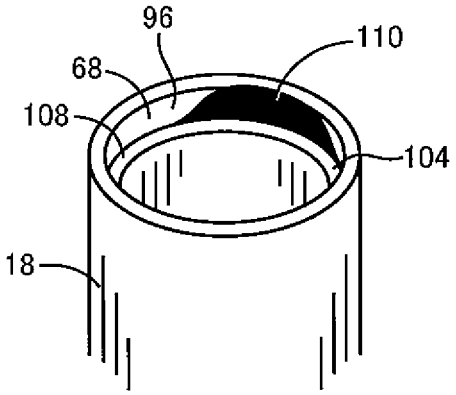
FIG. 4B is a perspective view illustrating the leakage of a viscous material from the comparative example plunger when the cartridge using the thin-walled plunger depicted in FIG. 4A is filled with the viscous material.

Describing next the experimental results, in the first experiment, the viscous material 14 did not leak from between the plunger 10 and the cylinder 18 at all. In contrast, in the second experiment, as depicted in FIG. 4B, a portion 110 (for illustration, colored black in the same figure) of the viscous material 14 leaked from between the thin-walled plunger 108 and the cylinder 18.

Finally, when considering the results of these experiments, the presence of the solid section and the tapered surface in the plunger 10 have been confirmed to be important for avoiding leakage of the viscous material 14 from between the plunger 10 and the cylinder 18.

The functions of the plunger 10 in the discharging stage will be described next.

As illustrated in FIG. 1, when the trigger 28 is pulled by the operator for discharging the viscous material 14 from the cartridge 12, pressurized air from the high pressure source 38 is introduced into the chamber 33 via the valve 32. When the pressurized air acts on the rear of the plunger 10, the plunger 10 is advanced relative to the cylinder 18, thereby expelling the viscous material 14 from the cylinder 18.

At this moment, the pressurized air in the chamber 33 (i.e., the second sub-chamber 74) attempts to flow to the chamber ahead of the plunger 10 (i.e., the first sub-chamber 72) bypassing through the radial clearances CL1, CL2 and CL3 between the plunger 10 and the cylinder 18. However, the second land 104 of the plunger 10, which serves as a movable land, is interference-fit in the cylinder 18, and the second land 104 closely contacts the cylinder 18 in spite of inner-diameter variation of the cylinder 18. As a result, leakage of pressurized air from the chamber 33 is prevented. Therefore, mixing of pressurized air into the viscous material 14 and expulsion of air from the cartridge 12 are prevented.

Now, the effect of the tapered surface on the inner circumferential surface 86 of the circumferential wall 84 will be described.

As illustrated in FIG. 3, the inner circumferential surface 86 of the circumferential wall 84 is tapered, and the ease of the elastic deformation of the circumferential wall 84 increases in the axial direction moving away from the first portion 80. On the other hand, the second land 104 is located within the circumferential wall 84 at the farthest position from the first portion 80. As a result, the circumferential wall 84 exhibits a larger amount of elastic deformation at the location of the second land 104 than at other axial location. This means that the properties of the second land 104, which serves as a movable land, are improved by the tapered surface on the inner circumferential surface 86 of the circumferential wall 84.

Next, other effects of the tapered surface on the inner circumferential surface 86 of the circumferential wall 84 will be described.

During the operation of the pneumatic dispenser 20, the plunger 10 is impinged with the flow of the pressurized air at its rear surface. The pressurized air, which generally flows in the axial direction, impacts against the inner circumferential surface 86 of the circumferential wall 84 and the partition wall surface 89. The force that advances the plunger 10 is produced from the portion of the pressurized air, which generally moves in the axial direction, that impacts the partition wall surface 89. On the other hand, the pressurized radial-forces CRF that press against the circumferential wall 84 in the radially outward direction are generated by the portion of the pressurized air, which generally moves in the axial direction, that impacts the inner circumferential surface 86 due to the sloping effect of the inner circumferential surface 86.

The plunger 10 is inserted into the cylinder 18 with the second land 104 contracted in the radially inward direction. As a result, prior to actuation of the pneumatic dispenser 20 (the static-pressure state in which there is no flow speed of the pressurized air), the second land 104 is pressed against the inner circumferential surface 96 of the cylinder 18 with initial radial forces IRF.

However, during the operation of the pneumatic dispenser 20 (dynamic-pressure state in which there is a flow speed of the pressurized air), pressurized radial-forces CRF are added to the initial radial forces IRF. As a result of this, the force that presses the outer circumferential surface of the second land 104 against the inner circumferential surface 96 of the cylinder 18, increases as compared to prior to the actuation of the pneumatic dispenser 20; as a result, the air tightness between the second land 104 and the cylinder 18 improves during the operation of the pneumatic dispenser 20. This air-tightness improvement contributes to the aforementioned viscous-material blockage and, more notably, the aforementioned air leak prevention.

As described above, the inner circumferential surface 86, which is a tapered surface on an interior side of the circumferential wall 84, functions as a deflector having a work surface that is inclined with respect to the axis of the plunger 10. When the flow of the pressurized air impinges on the work surface during the operation of the pneumatic dispenser 20, this deflector generates forces from the flow of the pressurized air that cause radial expansion of the circumferential wall 84, due to the sloping effect of the deflector, and these forces act on the surface of the circumferential wall 84.

Next, results obtained by the plunger 10 having the partition wall surface 89 will be described. Because the partition wall surface 89 is formed by utilizing the solid structure of the first portion 80, the results obtained by the plunger 10 having the partition wall surface 89 are also results obtained by the first portion 80 being solid.

During the operation of the pneumatic dispenser 20, the plunger 10 is impinged with the flow of the pressurized air at its rear surface. The pressurized air in motion impacts against the inner circumferential surface 86 of the circumferential wall 84 and the partition wall surface 89.

The partition wall surface 89 is located at the same position as the front end position of the inner circumferential surface 86; therefore, owing to the partition wall surface 89, none of the pressurized air, which has been introduced into the second sub-chamber 74, moves forward beyond the inner circumferential surface 86. As a result, as compared to a case in which a portion of the introduced pressurized air moves forward beyond the inner circumferential surface 86, such introduced pressurized air would be in effect blown against the inner circumferential surface 86. As a result of this, the pressurized radial forces CRF would be generated at higher levels; as a result, the air tightness between the second land 104 and the cylinder 18 would be further improved.

Next, reuse of the plunger 10 will be described.

The surface of the plunger 10 is coated with a synthetic resin (e.g., fluoropolymer, Teflon (registered trademark)) having less adhesive properties than the surface of the plunger 10. Although the plunger 10 is formed by a material having high surface-adhesiveness (e.g., more porosity), owing to the low-adhesive synthetic resin coating, it is possible to reuse the plunger 10 by more easily removing viscous material 14 attached to the plunger 10 by washing than if the plunger 10 has no coating.

Next, a filling method that fills the viscous material 14 into the cartridge 12 will be described.

Figure 5:
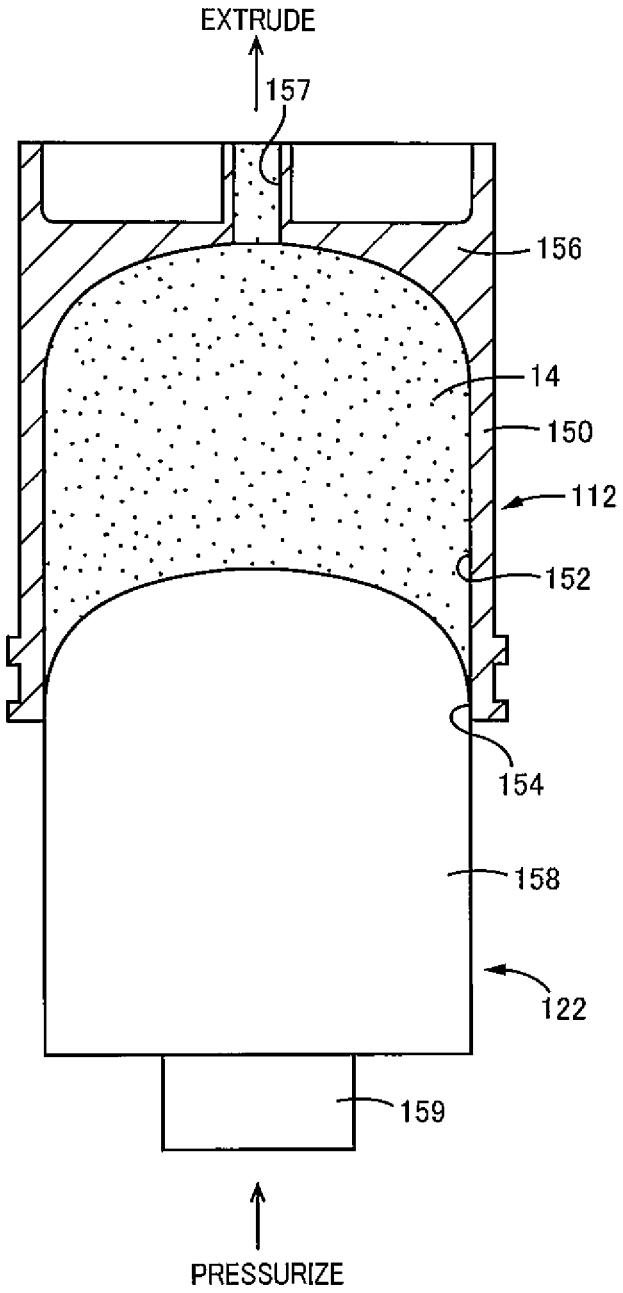
FIG. 5 is a cutaway cross-sectional side view illustrating a container set of a filling device for use in effecting a filling method for filling the cartridge depicted in FIG. 2 with the viscous material, the container set constructed by inserting a pusher piston into a container.

Prior to filling of the cartridge 12, the viscous material 14 is produced and stored in the container 112 depicted in FIG. 5. Then, the viscous material 14 that has been stored in the container 112 is dispensed from the container 112 into a plurality of cartridges 12. The viscous material 14 is extruded from the container 112 as the pusher piston 122 is forced into the container 112. The extruded viscous material 14 is filled into the cylinder 18.

FIG. 5 illustrates the container 112 in a cross-sectional side view. In the present embodiment, the same container 112 is used for the production of the viscous material 14 (two-component mixing, as described below), the degassing of the viscous material 14 (centrifugal vacuum degassing using a mixer, as described below) after the production thereof, the storage and transportation of the viscous material 14 prior to filling into the cartridge 12, and the filling to the cartridge 12.

As FIG. 5 illustrates, the container 112 has a longitudinally-extending hollow housing 150 and a cylindrical chamber 152 that is formed coaxially within the housing 150. The chamber 152 has an opening 154 and a base portion 156. The base portion 156 has a recess that forms a generally hemispherical shape. Because the base portion 156 has a continuous shape, the viscous material 14 flows in the chamber 152 more smoothly than if the base portion 156 had a flat shape; as a result, the mixing efficiency of the viscous material 14 is improved. An example of a material constituting the container 112 is POM (polyacetal); another example is Teflon (registered trademark), although these are not limiting.

In the base portion 156 of the chamber 152, a discharge passage 157 is formed for discharging the viscous material 14 (a mixture of Solutions A and B), which is contained within the chamber 152, into the cartridge 12; the discharge passage 157 is selectively closed by a removable plug (not shown).

As illustrated in FIG. 5, the pusher piston 122 is pushed into the chamber 152 of the container 112 in order to discharge the viscous material 14 from the container 112. The pusher piston 122 has a main body portion 158 and an engagement portion 159 formed at the rear end of the main body portion 158. The main body portion 158 has an exterior shape that is complementary to the interior shape of the chamber 152 of the container 112 (e.g., an exterior shape having a protrusion that forms a generally hemispherical shape). The engagement portion 159 is smaller in diameter than the main body portion 158; when an external force is loaded by a filling device 210, the pusher piston 122 advances. As the pusher piston 122 moves within the chamber 152 closer to the discharge passage 157, the viscous material 14 is extruded from the discharge passage 157.

Figure 6:
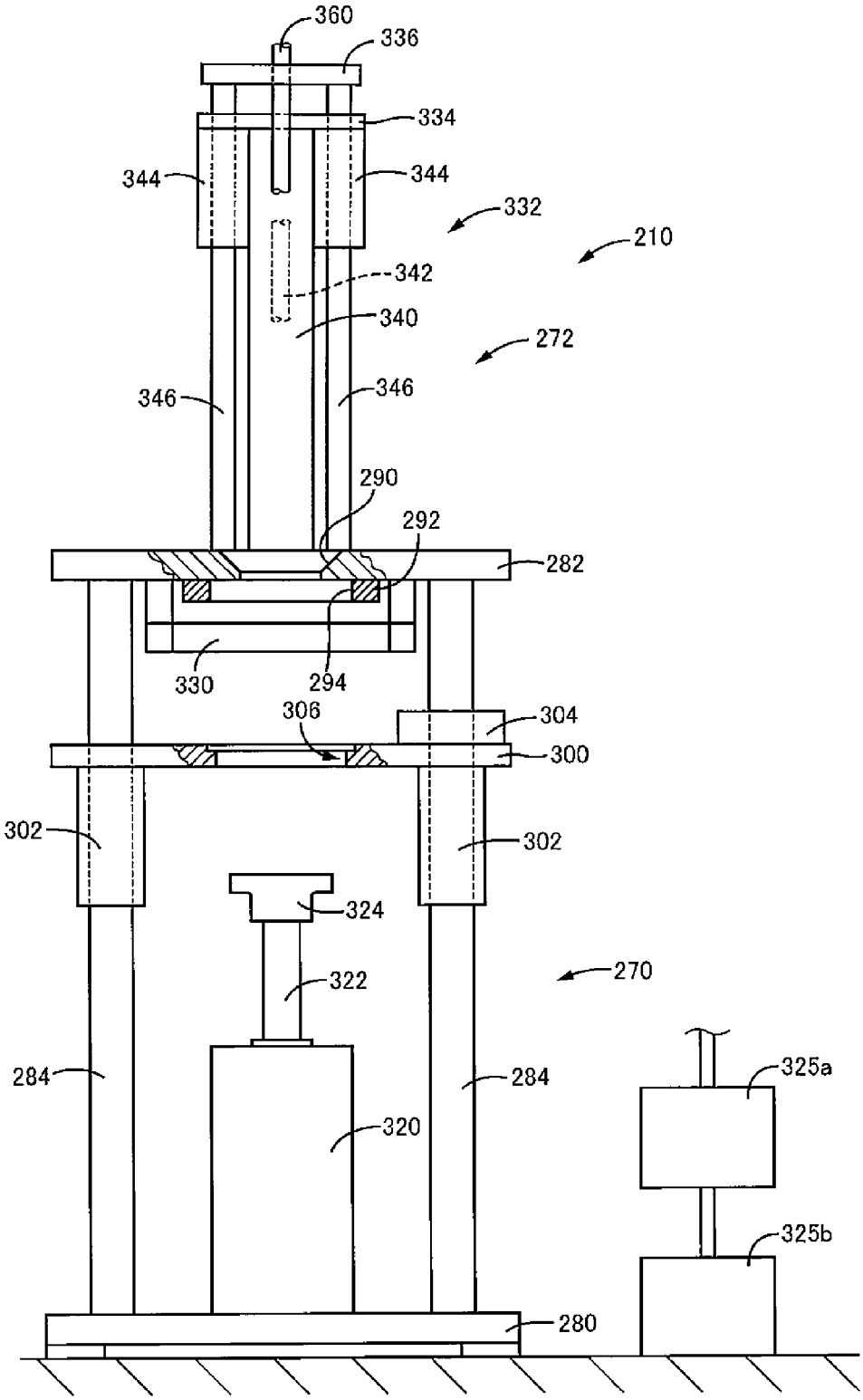
FIG. 6 is a cutaway cross-sectional front view illustrating the filling device.
Figure 7:
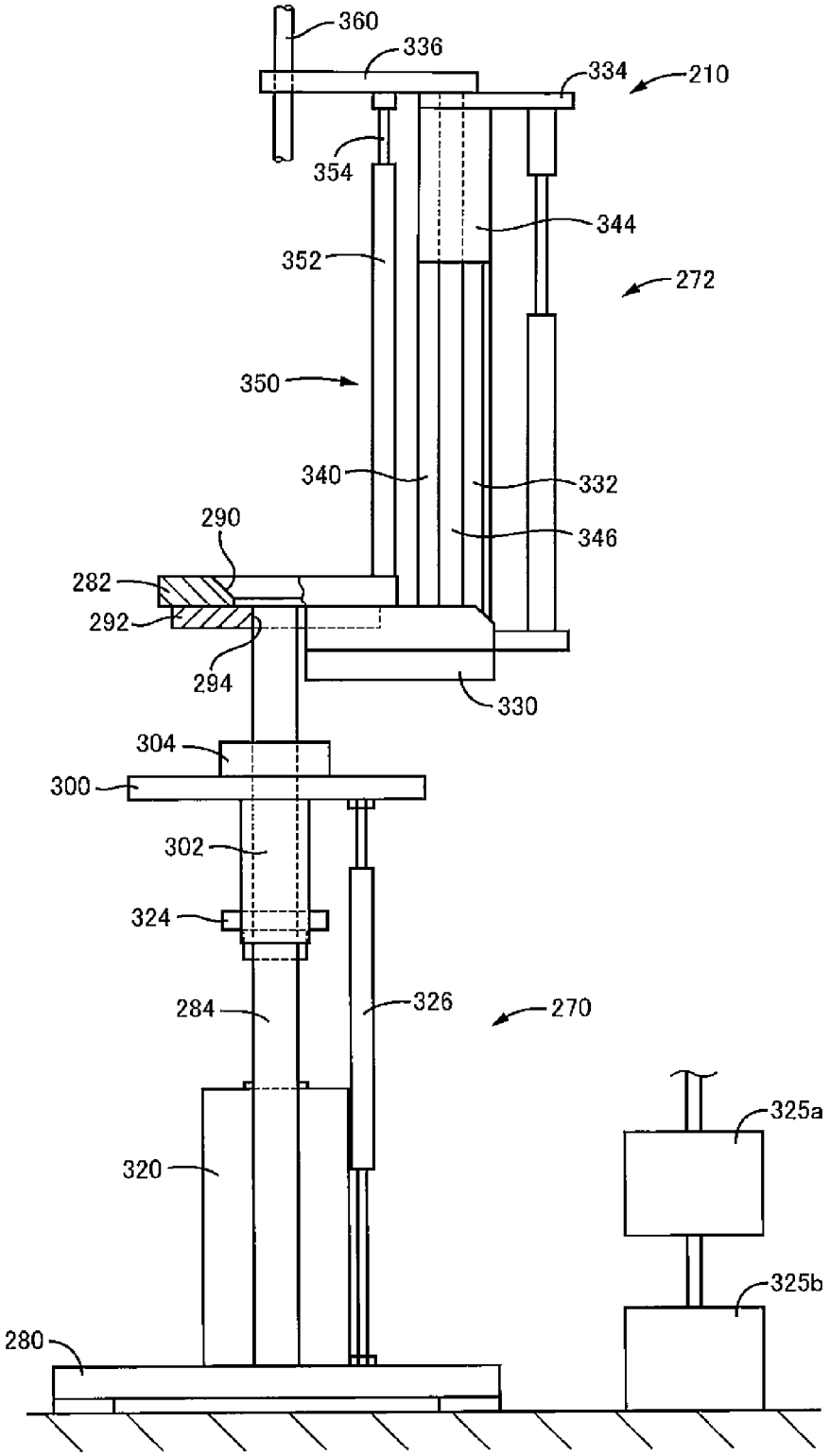
FIG. 7 is a cutaway cross-sectional side view illustrating the filling device.
Figure 8:
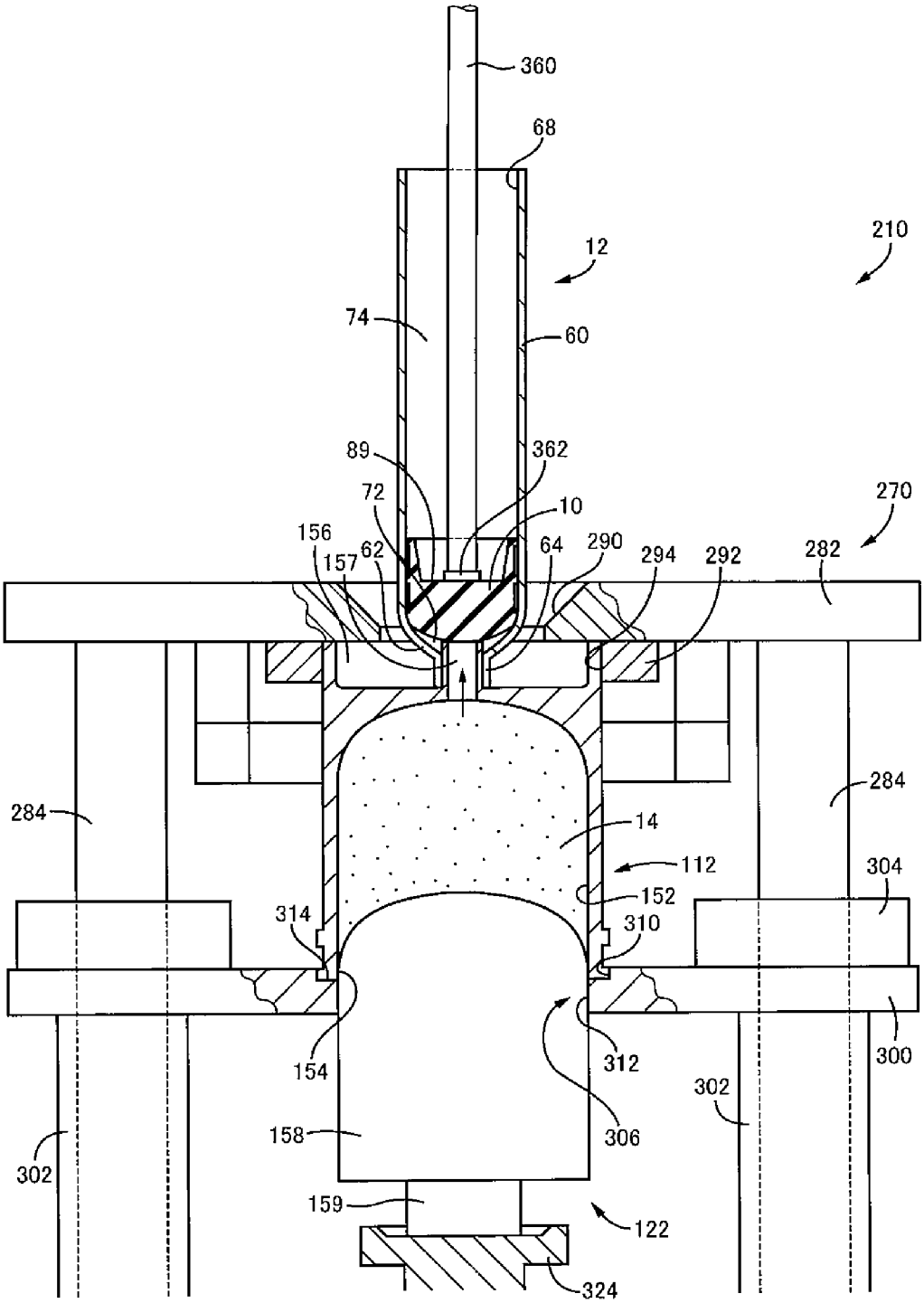
FIG. 8 is a cutaway cross-sectional front view illustrating a relevant portion of the filling device when in use.

FIG. 6 illustrates the filling device 210, which is for use in transferring the viscous material 14 from the container 112 to the cartridge 12, thereby filling the cartridge 12 with the viscous material 14, FIG. 7 illustrates the filling device 210 in a cutaway cross-sectional side view, and FIG. 8 illustrates a relevant portion of the filling device 210 when in use illustrating the filling device in a cutaway cross-sectional front view in enlargement.

In the present embodiment, while transferring the viscous material 14 from the container 112 to the cartridge 12, the container 112 is held in space, as illustrated in FIG. 8, such that the container 112 is oriented with the opening 154 of the chamber 152 facing downward and the discharge passage 157 of the base portion 156 facing upward (upside-down position). In this state, the pusher piston 122 is moved upwardly within the chamber 152. As a result, the viscous material 14 is upwardly extruded from the chamber 152.

Furthermore, while transferring the viscous material 14 from the container 112 to the cartridge 12, the cartridge 12 is held in space with the opening 68 facing upward and with the base portion 62 facing downward. In this state, when the viscous material 14 is upwardly extruded from the container 112, it is injected via the base portion 62 of the cartridge 12.

As FIGS. 6 and 7 illustrate, the filling device 210 at its lower portion has a container holder mechanism 270 that removably holds the container 112; on the other side, the filling device 210 at its upper portion has a cartridge holder mechanism 272 that removably holds the cartridge 12.

The container holder mechanism 270 has abase plate 280, which sits on the ground, a top plate 282, which is not vertically movable and is located above the base plate 280, and a plurality of vertical parallel shafts 284, each of which is fixedly secured at its two ends to the base plate 280 and the top plate 282 (in the present embodiment, two shafts disposed symmetrically relative to a vertical centerline of the container holder mechanism 270). The top plate 282 has a through hole 290. The through hole 290 is coaxial with the vertical centerline of the container holder mechanism 270.

A guide plate 292 is fixedly secured to a lower face of the top plate 282. The guide plate 292 has a guide hole 294 coaxial with the through hole 290. The guide hole 294 penetrates through the guide plate 292 in the thickness direction with a uniform cross-section. The guide hole 294, as illustrated in FIG. 8, has an inner diameter that is slightly larger than the outer diameter of the base portion 156 of the container 112, and it is possible to fit the container 112 within the guide hole 294 without any noticeable play. Due to the guide hole 294, the container 112 is aligned relative to the top plate 282 in the horizontal direction (the radial direction of the container 112).

As FIG. 8 illustrates, when the base portion 156 of the container 112 is in the state that it is fitted in the guide hole 294, the container 112 at a tip end surface of the base portion 156 (in the same flat plane) abuts on the lower surface of the top plate 282. As a result, the container 112 can be aligned relative to the top plate 282 in the vertical direction (the axial direction of the container 112).

As FIGS. 1 and 2 illustrate, the container holder mechanism 270 further has a vertically movable plate 300. The movable plate 300 has a plurality of sleeves 302, into which the shafts 284 are axially slidably fitted. By manipulating a lock mechanism 304, the operator can move the movable plate 300 and stop the movement in any position in the vertical direction.

The movable plate 300 has a stepped positioning hole 306 coaxial with the guide hole 294. The positioning hole 306 penetrates through the movable plate 300 in the thickness direction. As FIG. 8 illustrates, the positioning hole 306 has a larger-diameter hole 310 on the side closer to the guide hole 294, a smaller-diameter hole 312 on the opposite side, and a shoulder surface 314 between the larger-diameter hole 310 and the smaller-diameter hole 312 and facing towards the guide hole 294.

The larger-diameter hole 310 has an inner diameter that is slightly larger than the outer diameter of the opening 154 of the container 112 and the container 112 is aligned relative to the movable plate 300 (and therefore the top plate 282) in the horizontal direction (the radial direction of the container 112).

The tip end surface of the opening 154 of the container 112 (in the same flat plane) abuts on the shoulder surface 314, and the container 112 is aligned relative to the movable plate 300 (therefore the top plate 282) in the vertical direction (the axial direction of the container 112).

The smaller-diameter hole 312 has an inner diameter that is slightly larger than the outer diameter of the pusher piston 122, and the pusher piston 122 is slidably fitted into the smaller-diameter hole 312. The smaller-diameter hole 312 serves as a guide hole for guiding axial movement of the pusher piston 122.

A container set is constructed by inserting the pusher piston 122 into the container 112, and the container set is attached to the top plate 282, with the movable plate 300 sufficiently spaced from the top plate 282 in the downward direction. Thereafter, the movable plate 300 is upwardly moved until the tip end face of the opening 154 of the container 112 abuts on the shoulder surface 314. At this position, the movable plate 300 is fixedly secured to the shafts 284. As a result, the retention of the container set on the container holder mechanism 270 is completed.

As FIGS. 6 and 7 illustrate, the container holder mechanism 270 further has an air cylinder 320 serving as an actuator and coaxial with the guide hole 294. A rod 322, which serves as a vertically movable member, upwardly projects from the air cylinder 320, and a pusher 324 is affixed at the tip end of the rod 322. The pusher 324, as illustrated in FIG. 8, engages with the engagement portion 159 of the pusher piston 122 of the container set that is held in the container holder mechanism 270. In the engagement position, as the pusher 324 advances, the pusher piston 122 advances relative to the container 112 so as to reduce the volume of the chamber 152.

The air cylinder 320 is double-acting and, based on the operator' actions, the pusher 324 thereof selectively advances from an initial position to an active position (upward movement by pressurization), retreats from the active position to an inactive position (downward movement by pressurization), and stops at any desired position (from both gas chambers within the air cylinder 320). The air cylinder 320 is connected to a high-pressure source (its primary pressure is, e.g., 0.2 MPa) **325*b* via a hydraulic pressure control unit 325*a*** having flow control valve(s).

As FIG. 2 illustrates, the container holder mechanism 270 further has a gas spring 326 serving as a damper. The gas spring 326 extends vertically and is pivotably coupled at its two ends with the base plate 280 and the movable plate 300, respectively. The gas spring 326 is provided to restrict the downward movement of the movable plate 300 due to gravity when the lock mechanism 304 is in an unlocked position.

As FIGS. 6 and 7 illustrate, the cartridge holder mechanism 272 is equipped with a base frame 330 that is fixedly secured to the top plate 282, an air cylinder 332 serving as an actuator, a top frame 334 and a movable frame 336.

The air cylinder 332 has a vertically-extending main body 340, which is fixedly secured to the top plate 282 and the top frame 334, and a vertically-movable rod 342 that is linearly movable relative to the main body 340. The upper end of the vertically-movable rod 342 (the end of the vertically-movable rod 342 that projects from the main body 340) is fixedly secured to the movable frame 336.

The air cylinder 332 is double acting, and based on operator's actions, the vertically-movable rod 342 thereof selectively advances from an initial position to an active position (upward movement by pressurization), retreats from the active position to an inactive position (downward movement by pressurization), and floats at any desired position (permitting exhaust from both gas chambers in the air cylinder 332). That is, the air cylinder 332 can selectively switch between an advanced mode, a retracted mode and a floating mode. The air cylinder 332 is connected to the high pressure source 325*a* via a hydraulic pressure control unit 325*a*.

A plurality of sleeves 344 (in the present embodiment, two parallel sleeves disposed symmetrically with the air cylinder 332 interposed therebetween) are fixedly secured to the main body 340. A plurality of vertically-extending shafts 346 are slidably fitted into the respective sleeves 344. The upper end portion of each shaft 346 is fixedly secured to the movable frame 336.

Each of the base frame 330, the top frame 334, the main body 340 and the sleeves 344 is a stationary member in the cartridge holder mechanism 272, while the movable frame 336, the vertically-movable member 142, and the shafts 346 are each movable members that vertically move in unison.

As FIG. 7 illustrates, the cartridge holder mechanism 272 is further equipped with a gas spring 350 serving as a damper. The gas spring 350 extends vertically between the base frame 330 and the movable frame 336. The gas spring 350 is equipped with a cylinder 352 having a gas chamber (not shown), and a rod 354 that is extendable and retractable relative to the cylinder 352. At one end thereof, it is pivotably coupled to the base frame 330.

A tip end of the rod 354 detachably engages a lower surface of the movable frame 336. As a result, although the movable frame 336 can compress the rod 354, it cannot extend the rod 354. When in a compressed state, the rod 354 applies an upward force against the movable frame 336, which assists the upward movement of the movable frame 336.

In the present embodiment, the container 112 and the cartridge 12 are directly coupled together, e.g., by screwing together male and female threads, with the container 112 retained in the filling device 210, and the cartridge 12 is aligned relative to the container 112 in both of the radial direction and the axial direction.

As FIG. 8 illustrates, a rod 360 is inserted into the cartridge 12, with the aforementioned container set held by the container holder mechanism 270, and with the aforementioned container set coupled to the cartridge 12.

The rod 360 is held by the cartridge holder mechanism 272. In the present embodiment, the cartridge holder mechanism 272 holds the rod 360 and the rod 360 is, in turn, inserted into the cartridge 12; consequently, the cartridge 12 is held by the cartridge holder mechanism 272.

The rod 360 is in the form of a tube which extends linearly and is rigid, and a second plug 190, which is fixedly secured to the tip end of the vacuum tube 182. The rod 360 is a steel pipe (can be replaced with a plastic pipe), and is capable of transmitting compressive forces in the axial direction.

The rod 360 has an anterior end portion a tip end surface of which is closed in an air-tight manner by a stop 362. The stop 362 at its tip end surface is in abutment with the partition wall surface 89 of the plunger 10, which sets a definite approaching limit of the rod 360 relative to the plunger 10.

As FIG. 8 illustrates, by pushing the pusher piston 122 into the container 112, viscous material 14 is extruded from the container 112 via the base portion 156, and the extruded viscous material 14 fills the first sub-chamber 72. As the volume of viscous material 14 filling the first sub-chamber 72 increases, the plunger 10 is further displaced by the viscous material 14 and moves upwardly relative to the cylinder 18. Therefore, the rod 360 moves upwardly relative to the cartridge 12.

As FIGS. 6 and 7 illustrate, the rod 360 is fixedly secured to the movable frame 336. The rod 360 extends coaxially with the vertical centerline of the filling device 210 (coaxial with the centerline of the guide hole 294). Owing to the filling device 210, the cartridge 12 is aligned relative to the top plate 282.

Next, the filling method will be described in more detail with reference to the process flowchart depicted in FIG. 9, which is followed by description of how to prepare the viscous material 14.

The viscous material 14 is a high-viscosity synthetic resin, and exhibits thermosetting properties, such that the viscous material 14 cures when heated above a prescribed temperature (e.g., 50° C.); once cured, the original properties of the viscous material 14 will not be restored even if the temperature decreases. In addition, the viscous material 14 also exhibits the property that, when the viscous material 14 is cooled below a prescribed temperature (e.g., −20° C.) prior to curing and is frozen, the chemical reaction (curing) in the viscous material 14 stops. Thereafter, when the viscous material 14 is heated and thawed, the chemical reaction (curing) in the viscous material 14 restarts.

In the present embodiment, the viscous material 14 is a two-part mix type that is furnished by mixing two solutions, which are "Solution A" (curing agent) and "Solution B" (major component). An example of "Solution A" is PR-1776 B-2, Part A (i.e., an accelerator component, and a manganese dioxide dispersion) of PRC-DeSoto International, U.S.A., and an example of "Solution B," which is combined with Solution A, is PR-1776 B-2, Part B (i.e., a base component, and a filled modified polysulfide resin) of PRC-DeSoto International, U.S.A.

Therefore, as FIG. 9 illustrates, in order to produce the viscous material 14, the two parts are first mixed in the container 112 in step S11. Next, in step S12, agitating and degassing are performed on the viscous material 14 held in the container 112 using a mixer (not shown). In the present embodiment, the same container 112 is used to mix the two parts for the production of the viscous material 14, and to agitate and degas the viscous material 14 using the mixer.

An example of such a mixer is disclosed in Japanese Patent Application Publication No. HEI 11-104404, the content of which is incorporated herein by reference in its entirety. In the present embodiment, such a mixer is used to orbit the container 112 around an orbital axis and simultaneously rotate the container 112 about a rotational axis that is eccentric to the orbital axis, with the container 112 filled with the viscous material 14 under a vacuum, so that the viscous material 14 can be simultaneously agitated and degassed within the container 112.

The viscous material 14 within the mixer is agitated due to the centrifugal force created by the planetary motion produced by the mixer. Further, air bubbles trapped in the viscous material 14 are released from the viscous material 14, due to the synergistic effect of the centrifugal force generated by the planetary motion of the mixer and the negative pressure caused by the vacuum atmosphere; as a result, the viscous material 14 is degassed. This completely or adequately prevents generation of voids within the viscous material 14.

After the viscous material 14 has been mixed and agitated/degassed within the container 112 in the manner described above, an operation that transfers and fills the viscous material 14 from the container 112 into the cartridge 12 starts as illustrated in FIG. 8.

In step S21, the operator first inserts the plunger 20 into the container 112 that has been filled with the viscous material 14, as illustrated in FIG. 5, to thereby prepare the container set.

Next, in step S22, the operator next attaches the container set to the container holder mechanism 270 of the filling device 210 with the container set inverted, as illustrated in FIG. 8, to thereby retain the container set in the filling device 210.

More specifically, prior to the retention of the container set in the container holder mechanism 270, the movable plate 300 is retreated downwardly from the container set. The operator first puts the container set on the retreated movable plate 300 at a prescribed position and in an inverted orientation. Thereafter, the operator raises the movable plate 300 together with the container set until the container 112 abuts on the top plate 282. Lastly, the operator fixes the movable plate 300 at that position.

Subsequently, in step S23, the operator inserts the plunger 10 into the cartridge 12 as illustrated in FIG. 8, to thereby prepare the cartridge 12.

Thereafter, in step S24, the cartridge 12 is coupled to the container set, which was previously retained by the filling device 210 in an inverted orientation, in a substantially air-tight manner, as illustrated in FIG. 8, thereby retaining the cartridge 12 in the filling device 210.

Prior to the attachment of the cartridge 12 to the filling device 210, the air cylinder 332 is placed in the aforementioned advanced mode, in which the vertically-movable rod 342 is pushed out; as a result, the rod 360 is in a position that is upwardly retreated from the cartridge 12. In other words, the rod 360 does not obstruct the attachment of the cartridge 12 to the filling device 210.

Subsequently, in step S25, the air cylinder 332 is switched to the aforementioned retracted mode to retract the vertically-movable rod 342 and to thereby insert the retreated rod 360 into the cartridge 12. The rod 360 is downwardly moved by the air cylinder 332 until the stop 362 of the rod 360 abuts on the plunger 10, which was previously put into the cartridge 12. An advancing limit of the plunger 10 is defined by, for example, abutting on a tip end portion of a portion, which forms the discharge passage 157, within the base portion 156 of the container 112.

Thereafter, the air cylinder 332 is switched to the aforementioned floating mode; as a result, if the assistance by the gas spring 350 is disregarded, the force acting on the plunger 10 from the rod 360 has a value equal to the summation of the weight of the rod 360 and the weight of member(s), which move together with the rod 360, minus the value of the sliding resistance. This force is a force that urges the plunger 10 in the direction towards the base portion 62 of the cartridge 12, and is a force that reduces the volume of the first sub-chamber 72.

Thereafter, in step S26, the pusher piston 122 rises and is pushed into the container 112, as illustrated in FIG. 8. With this, the viscous material 14 is extruded from the container 112 against the force of gravity, to thereby initiate the filling of the first sub-chamber 72.

When the viscous material 14 flows from the container 112 into the first sub-chamber 72 of the cartridge 12, air present within the first sub-chamber 72 is compressed by the in-flowing viscous material 14.

As a result, a pressure differential is generated within the cartridge 12, because the first sub-chamber 72 is at a higher pressure than the second sub-chamber 74 (at atmospheric pressure), which is in communication with outside of the cartridge 12. Due to this pressure differential, air within the first sub-chamber 72 flows into the second sub-chamber 74 via the radial clearances between the cartridge 12 and the plunger 10, more specifically, a series of the first clearance CL1 between the first land 94 and the inner circumferential surface 96 of the cylinder 18, the second clearance CL3 between the third land 106 and the inner circumferential surface 96 of the cylinder 18, and the second clearance CL2 between the second land 96 and the inner circumferential surface 96 of the cylinder 18 in a description order, and consequently, it is discharged from the opening 68 of the cartridge 12 to the outside. This allows the air in the first sub-chamber 72 to be degassed.

As a result, according to the present embodiment, during the filling of the viscous material 14 into the first sub-chamber 72, the air is discharged from the first sub-chamber 72, air is prevented from being incorporated into the viscous material 14 within the first sub-chamber 72, and co-existence of the viscous material 14 and air within the first sub-chamber 72 is prevented.

Further, according to the present embodiment, a force is applied to the plunger 10 within the cartridge 12 by the rod 360 in the direction that reduces the volume of the first sub-chamber 72. The applied force is a force that displaces the plunger 10 towards the viscous material 14 that has flowed into the cartridge 12.

For these reasons, according to the present embodiment, due to the application of the aforementioned force by the rod 360, the above-mentioned pressure differential is again created and a larger pressure differential is generated within the cartridge 12 than if a force were not applied by the rod 360. A phenomenon is thereby promoted that air present within the first sub-chamber 72 flows into the second sub-chamber 74 through the radial clearances between the plunger 10 and the cartridge 12.

Thereafter, the entire first sub-chamber 72, which is in the initial state depicted in FIG. 8 (in which the plunger 10 is located at its lowermost position), is filled with the viscous material 14 (replacing the air initially present within the first sub-chamber 72 with viscous material 14). Subsequently, as the filling of the viscous material 14 continues, the volume of the first sub-chamber 72 increases and the plunger 10, the rod 360 and the movable frame 336 rise. At this moment, the viscous material 14 within the first sub-chamber 72 is prevented from leaking into the second sub-chamber 74 by the above-described triple blockage of the viscous material 14.

In the present embodiment, the viscous material 14 is filled into the plunger 10 via not the opening 68 but the discharge port 67, thereby, in an initial period from the start of the filling operation, creating a layer of air (an upper layer) closer to the plunger 10 in the first sub-chamber 72, and a layer of the viscous material 14 below the layer of air. As a result, as long as air is present within the first sub-chamber 72, the viscous material 14 is prevented from being brought into contact with the plunger 10.

When the viscous material 14 rises up in the first sub-chamber 72 and the first sub-chamber 72 is fully degassed, the viscous material 14 is brought into contact with the plunger 10 and enters the clearances between the plunger 10 and the cylinder 18. As a result, seals are created between the plunger 10 and the cylinder 18 for performing the aforementioned blockage of the viscous material 14. After the completion of the seals, bi-directional air-leakage is also inhibited.

Prior to the filling of the viscous material 14 into the cartridge 12, the gas spring 350 depicted in FIG. 7 is in a compressed state due to the movable frame 336. As a reaction thereto, the gas spring 350 applies a force to the movable frame 336 that lifts the movable frame 336 together with the rod 360.

Therefore, after the entire first sub-chamber 72, which is in the initial state depicted in FIG. 8 (the plunger 10 is located at its lowermost position), is filled with the viscous material 14, and when the volume of the first sub-chamber 72 further increases, it is thereby possible to raise the plunger 10, the rod 360 and the movable frame 336 without increasing much the pressure of the viscous material 14 within the first sub-chamber 72.

In other words, in step S27, the lifting of the rod 360 and the movable frame 336 is mechanically assisted by the gas spring 152.

Thereafter, in step S28, it is waited for the amount of the viscous material 14 that has filled into the cylinder 18 reaches a prescribed value, and for the rod 360 rises up to a prescribed position. If the rod 360 rises up to the prescribed position, then the air cylinder 320 makes a shift to stop further advance of the pusher piston 122, which is followed by an action in which the air cylinder 332 extends the vertically-movable rod 342, thereby lifting the rod 360 with the plunger 10 remaining in the cartridge 12, and retracting the rod 360 from the cartridge 12.

Subsequently, in step S29, the cartridge 12 is removed from the container 112 and the filling device 210. Thereafter, in step S30, the container set is removed from the filling device 210. Then, the transferring and filling of the viscous material 14 from one unit of the container 112 to one unit of the cartridge 12 is completed.

The present specification provides a complete description of the compositions of matter, methodologies, systems and/or structures and uses in exemplary implementations of the presently-described technology. Although various implementations of this technology have been described above with a certain degree of particularity, or with reference to one or more individual implementations, those skilled in the art could make numerous alterations to the disclosed implementations without departing from the spirit or scope of the technology thereof. Furthermore, it should be understood that any operations may be performed in any order, unless explicitly claimed otherwise or a specific order is inherently necessitated by the claim language. It is intended that all matter contained in the above description and shown in the accompanying drawings shall be interpreted as illustrative only of particular implementations and are not limiting to the embodiments shown. Changes in detail or structure may be made without departing from the basic elements of the present technology as defined in the following claims.

The invention claimed is:

1. A plunger for use by being fitted into a circular-shaped cylinder of a pneumatic dispenser that employs pressurized air to discharge a viscous material, wherein the plunger is configured to divide an inner chamber of the cylinder into a first sub-chamber that stores the viscous material and a second sub-chamber into which the pressurized air is charged, the first and second sub-chambers being coaxially aligned with each other, the plunger has a first portion configured to face the first sub-chamber and a second portion configured to face the second sub-chamber, the first and second portions being coaxially aligned with each other, the second portion is a hollow structure having a circumferential wall that is configured to be coaxially aligned with an inner circumferential surface of the cylinder, the circumferential wall being an elastic structure that is elastically deformable in a radial direction of the plunger, the first portion is an at least substantially solid structure and is more rigid than the second portion, an outer circumferential surface of the first portion has a first annular groove and a first land, which extend circumferentially around an axial direction of the plunger, the first land is configured to locally oppose the inner circumferential surface of the cylinder, the first land has an outer diameter that is sized so as to provide a first radial clearance with the inner circumferential surface of the cylinder, the first radial clearance has a radial dimension that enables venting of air, which is within the first sub-chamber, from the first sub-chamber to the second sub-chamber when viscous material is filled into the first sub-chamber, while blocking viscous material from flowing from the first sub-chamber to the second sub-chamber due to the viscosity of the viscous material, and the first land is not displaceable in the radial direction with respect to the axial direction of the plunger, an outer circumferential surface of the second portion has a second annular groove and a second land, which extend circumferentially around the axial direction of the plunger, the second land has an outer diameter that is sized so as to be at least substantially in local contact with the inner circumferential surface of the cylinder such that said air venting and said viscous-material blockage are achieved, and such that pressurized air, which is within the second sub-chamber, is at least substantially prevented from flowing from the second sub-chamber to the first sub-chamber by leaking between the second land and the cylinder, and the second land is displaceable in the radial direction with respect to the axial direction of the plunger, and in a free state in which external forces are not being applied to the plunger, the outer diameter of the first land is smaller than the outer diameter of the second land.

2. The plunger according to claim 1, further having:

a third land extending along an annular boundary between the first land and the second land, wherein the third land has an outer diameter sized so as to provide a second radial clearance with the inner circumferential surface of the cylinder, such that said air venting and said viscous-material blockage are achieved, and the third land, the first land and the second land of the plunger are respectively configured to locally oppose the inner circumferential surface of the cylinder.

3. The plunger according to claim 2, wherein the outer diameter of the third land is at least substantially equal to the outer diameter of the first land.

4. The plunger according to claim 1, wherein the circumferential wall of the second portion has a thickness and a bending stiffness that decrease in the axial direction moving away from the first portion, such that the circumferential wall is more easily displaceable in the radial direction at a first end that is remote from the first portion than at a second end that is adjacent to the first portion.

5. The plunger according to claim 4, wherein:

an inner circumferential surface of the circumferential wall is tapered such that an inner diameter of the circumferential wall increases in the axial direction moving away from the first portion, and an outer circumferential surface of the circumferential wall is non-tapered.

6. The plunger according to claim 1, further having:

a deflector disposed on an interior side of the circumferential wall and having a work surface that is inclined relative to the axial direction of the plunger, wherein the deflector is configured to, in response to a flow of pressurized air that impinges on the work surface during operation of the pneumatic dispenser, generate, from the flow of pressurized air, forces in directions that cause the circumferential wall to radially expand, and to direct the forces onto the surface of the circumferential wall.

7. The plunger according to claim 1, wherein the first portion has a partition wall surface that separates an inner chamber of the second portion from a solid section of the first portion.

8. The plunger according to claim 1, wherein the plunger has a length in the axial direction that is about 70% or greater than the outer diameter of the first land.

9. The plunger according to claim 1, wherein the plunger has a surface coated with a synthetic resin having less adhesiveness than the surface of the plunger, whereby it is possible to reuse the plunger by removing any viscous material attached thereto by washing.

10. The plunger according to claim 3, wherein:

an inner circumferential surface of the circumferential wall of the second portion is tapered such that an inner diameter of the circumferential wall increases in the axial direction moving away from the first portion, an outer circumferential surface of the circumferential wall is non-tapered such that a thickness and a bending stiffness of the second portion decrease in the axial direction moving away from the first portion and the circumferential wall is more easily displaceable in the radial direction at a first end that is remote from the first portion than at a second end that is adjacent to the first portion, and the plunger has a length in the axial direction that is about 70% or greater than the outer diameter of the first land.

11. A pneumatic dispenser comprising:

a cylinder having a circular inner circumferential surface surrounding a hollow inner chamber and a viscous material discharge port located at one end thereof, and a plunger slidably fitted in the cylinder such that the plunger divides the hollow inner chamber into a first sub-chamber that holds viscous material and a second sub-chamber, into which pressurized air is chargeable, the first sub-chamber being coaxially aligned with the second sub-chamber, wherein a first portion of the plunger faces the first sub-chamber and a second portion of the plunger faces the second sub-chamber, the first portion being coaxially aligned with the second portion, the second portion is a hollow structure having an elastic circumferential wall that is coaxially aligned with the inner circumferential surface of the cylinder and is elastically deformable in a radial direction of the plunger, the first portion is an at least substantially solid structure that is more rigid than the second portion, a first annular groove and a first land are respectively defined on an outer circumferential surface of the first portion and circumferentially extend about an axial direction of the plunger, a first radial clearance is defined between the first land and the inner circumferential surface of the cylinder and has a radial dimension that enables venting of air, which is located within the first sub-chamber, from the first sub-chamber to the second sub-chamber when viscous material is filled into the first sub-chamber, while blocking viscous material from flowing from the first sub-chamber to the second sub-chamber due to the viscosity of the viscous material, the first land is not displaceable in the radial direction with respect to the axial direction of the plunger, a second annular groove and a second land are respectively defined on an outer circumferential surface of the second portion and circumferentially extend around the axial direction of the plunger, the second land at least substantially contacts the inner circumferential surface of the cylinder such that said air venting and said viscous-material blockage are achieved, and such that pressurized air, which is located within the second sub-chamber, is at least substantially prevented from flowing from the second sub-chamber to the first sub-chamber by leaking between the second land and the inner circumferential surface of the cylinder, the second land is displaceable in the radial direction with respect to the axial direction of the plunger, and in a free state in which external forces are not being applied to the plunger, the outer diameter of the first land is smaller than the outer diameter of the second land.

12. The pneumatic dispenser according to claim 11, further having:

a third land annularly extending on an outer circumferential surface of the plunger and located between the first land and the second land, wherein a second radial clearance is defined between the third land and the inner circumferential surface of the cylinder that enables said air venting and said viscous-material blockage.

13. The pneumatic dispenser according to claim 12, wherein the third land has an outer diameter that is at least substantially equal to the outer diameter of the first land.

14. The pneumatic dispenser according to claim 13, wherein the circumferential wall of the second portion has a thickness and a bending stiffness that decrease in the axial direction moving away from the first portion, such that the circumferential wall is more easily displaceable in the radial direction at a first end that is remote from the first portion than at a second end that is adjacent to the first portion.

15. The pneumatic dispenser according to claim 14, wherein:

an inner circumferential surface of the circumferential wall is tapered such that an inner diameter of the circumferential wall increases in the axial direction moving away from the first portion, and an outer circumferential surface of the circumferential wall is non-tapered.

16. The pneumatic dispenser according to claim 13, further having:

a deflector disposed on an interior side of the circumferential wall and having a work surface that is inclined relative to the axial direction of the plunger, wherein the deflector is configured to, in response to a flow of pressurized air that impinges on the work surface during operation of the pneumatic dispenser, generate, from the flow of pressurized air, forces in directions that cause the circumferential wall to radially expand, and to direct the forces onto the surface of the circumferential wall.

17. The pneumatic dispenser according to claim 15, wherein the first portion has a partition wall surface that separates an inner chamber of the second portion from a solid section of the first portion.

18. The pneumatic dispenser according to claim 17, wherein the plunger has a length in the axial direction that is about 70% or greater than the outer diameter of the first land.

19. The pneumatic dispenser according to claim 18, wherein the plunger has a surface coated with a synthetic resin having less adhesiveness than the surface of the plunger.

20. A plunger configured to slidably fit in a hollow circular cylinder such that the plunger divides a hollow inner chamber of the cylinder into a first sub-chamber that holds viscous material and a second sub-chamber, the first sub-chamber being coaxially aligned with the second sub-chamber, the plunger comprising:

a first portion configured to face the first sub-chamber, the first portion being an at least substantially solid structure, and a second portion integrally coupled to, and coaxially aligned with, the first portion, the second portion being configured to face the second sub-chamber and being a hollow structure having an elastic circumferential wall that: (i) is less rigid than the first portion, (ii) is coaxially aligned with the inner circumferential surface of the cylinder, and (iii) is elastically deformable in a radial direction of the plunger, wherein a first annular groove and a first land, which has a first outer diameter, are respectively defined on an outer circumferential surface of the first portion and circumferentially extend about the axial direction of the plunger, a second annular groove and a second land, which has a second outer diameter, are respectively defined on an outer circumferential surface of the second portion and circumferentially extend around the axial direction of the plunger, and in a free state in which external forces are not being applied to the plunger, the first outer diameter is smaller than the second outer diameter.

21. A dispenser comprising:

a cylinder having a circular inner circumferential surface surrounding a hollow inner chamber and a viscous material discharge port located at one end thereof, and a plunger slidably fitted in the cylinder such that the plunger divides the hollow inner chamber into a first sub-chamber that holds viscous material and a second sub-chamber, the first sub-chamber being coaxially aligned with the second sub-chamber, wherein a first portion of the plunger faces the first sub-chamber and a second portion of the plunger faces the second sub-chamber, the first portion being coaxially aligned with the second portion, a first annular groove and a first land are respectively defined on an outer circumferential surface of the first portion and circumferentially extend about an axial direction of the plunger, a first radial clearance between the first land and the inner circumferential surface of the cylinder is defined circumferentially around the first land and has a radial dimension that enables venting of air, which is within the first sub-chamber, from the first sub-chamber to the second sub-chamber when viscous material is filled into the first sub-chamber, while blocking viscous material from flowing from the first sub-chamber to the second sub-chamber due to the viscosity of the viscous material, a second annular groove and a second land are respectively defined on an outer circumferential surface of the second portion and circumferentially extend around the axial direction of the plunger, and the second land at least substantially contacts the inner circumferential surface of the cylinder circumferentially therearound such that said air venting and said viscous-material blockage are achieved, and such that air, which is within the second sub-chamber, is at least substantially prevented from flowing from the second sub-chamber to the first sub-chamber by leaking between the second land and the inner circumferential surface of the cylinder.

22. The dispenser according to claim 21, wherein, in a free state in which external forces are not being applied to the plunger, an outer diameter of the first land is smaller than an outer diameter of the second land.

23. The dispenser according to claim 22, wherein:

the second portion is a hollow structure having an elastic circumferential wall that is coaxially aligned with the inner circumferential surface of the cylinder and is elastically deformable in a radial direction of the plunger, the first portion is an at least substantially solid structure that is more rigid than the second portion, the first land is not displaceable in the radial direction with respect to the axial direction of the plunger, and the second land is displaceable in the radial direction with respect to the axial direction of the plunger.

* * * * *